US009142378B2

(12) United States Patent
Sekoguchi et al.

(10) Patent No.: US 9,142,378 B2
(45) Date of Patent: Sep. 22, 2015

(54) ION GENERATING DEVICE AND ELECTRICAL APPARATUS WHICH CAN EASILY BE REDUCED IN SIZE AND THICKNESS

(75) Inventors: Yoshinori Sekoguchi, Osaka (JP); Minako Sugano, Osaka (JP); Yasuhiro Iwashita, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 36 days.

(21) Appl. No.: 13/817,736

(22) PCT Filed: Jul. 12, 2011

(86) PCT No.: PCT/JP2011/065859

§ 371 (c)(1),
(2), (4) Date: Feb. 19, 2013

(87) PCT Pub. No.: WO2012/023362

PCT Pub. Date: Feb. 23, 2012

(65) Prior Publication Data

US 2013/0146781 A1 Jun. 13, 2013

(30) Foreign Application Priority Data

Aug. 20, 2010 (JP) ..... 2010-185332

(51) Int. Cl.
*H01J 27/24* (2006.01)
*H01J 27/02* (2006.01)
*H01T 23/00* (2006.01)

(52) U.S. Cl.
CPC ..... *H01J 27/022* (2013.01); *H01T 23/00* (2013.01)

(58) Field of Classification Search
CPC ..... H01J 27/022; H01J 23/00
USPC ..... 250/423 R, 424, 426, 427, 423 P, 423 F, 250/281, 282, 285, 288; 361/225, 230, 231
See application file for complete search history.

(56) References Cited

U.S. PATENT DOCUMENTS

| | | | | |
|---|---|---|---|---|
| 4,668,843 | A * | 5/1987 | Watanabe et al. | 200/5 A |
| 4,742,428 | A * | 5/1988 | Conrad | 361/606 |
| 5,342,207 | A * | 8/1994 | Sobhani | 439/74 |
| 8,053,741 | B2 * | 11/2011 | Sekoguchi | 250/424 |
| 2004/0130271 | A1 * | 7/2004 | Sekoguchi et al. | 315/111.81 |
| 2004/0145853 | A1 * | 7/2004 | Sekoguchi et al. | 361/225 |
| 2005/0208904 | A1 * | 9/2005 | Sit et al. | 455/90.3 |
| 2009/0096562 | A1 * | 4/2009 | Nakadai et al. | 336/67 |
| 2009/0230297 | A1 * | 9/2009 | Mizutani | 250/281 |
| 2009/0283692 | A1 * | 11/2009 | Sekoguchi | 250/423 F |
| 2011/0155922 | A1 * | 6/2011 | Funabiki et al. | 250/423 R |
| 2012/0056541 | A1 * | 3/2012 | Mamiya et al. | 315/111.81 |
| 2012/0068082 | A1 * | 3/2012 | Noda | 250/423 R |

FOREIGN PATENT DOCUMENTS

| | | | |
|---|---|---|---|
| CN | 101485057 | A | 7/2009 |
| EP | 0295914 | A2 | 12/1988 |

(Continued)

*Primary Examiner* — Michael Logie
*Assistant Examiner* — Jason McCormack
(74) *Attorney, Agent, or Firm* — Birch, Stewart, Kolasch & Birch, LLP

(57) ABSTRACT

An arrangement area of a transformer drive circuit, an arrangement area of a high-voltage transformer, and an arrangement area of an ion generating unit are two-dimensionally divided from each other in a casing. A connection terminal is electrically connected to the transformer drive circuit and is formed of a conductive film arranged to be exposed to the outside of the casing. Accordingly, an ion generating device whose size and thickness can be easily reduced and an electrical apparatus including the ion generating device can be provided.

6 Claims, 6 Drawing Sheets

(56) References Cited

FOREIGN PATENT DOCUMENTS

| | | | | |
|---|---|---|---|---|
| EP | 2043213 | A1 | * | 4/2009 |
| JP | 6-237059 | A | | 8/1994 |
| JP | 2002-374670 | A | | 12/2002 |
| JP | 2008-16345 | A | | 1/2008 |
| JP | 2008-210817 | A | | 9/2008 |
| JP | 2009-531828 | A | | 9/2009 |
| JP | 2009-290044 | A | | 12/2009 |
| WO | 2007/119956 | A1 | | 10/2007 |

* cited by examiner

ION GENERATING DEVICE AND ELECTRICAL APPARATUS WHICH CAN EASILY BE REDUCED IN SIZE AND THICKNESS

TECHNICAL FIELD

The present invention relates to ion generating devices and electrical apparatuses, and more particularly, to an ion generating device and an electrical apparatus that include a transformer drive circuit, a transformer, and an ion generating unit.

BACKGROUND ART

Many ion generating devices that utilize a discharge phenomenon have been put into practical use. These ion generating devices generally include an ion generating unit for generating ions, a high-voltage transformer for supplying a high voltage to the ion generating unit, a high-voltage transformer drive circuit for driving the high-voltage transformer, and a power supply input portion such as a connector.

Ion generating units may be roughly categorized into two types. One type uses a metal wire, a metal plate having an acute portion, a needle-shaped metal part, etc., as a discharge electrode and a metal plate, a grid, etc., at a ground potential as a counter electrode. The counter electrode may be omitted when the ground is used as a counter electrode. In this type of ion generating unit, air serves as an insulator. When a high voltage is applied between the electrodes of the ion generating unit, an electric field concentration occurs at the tip of the electrode having an acute portion and electrical breakdown of air occurs in the immediate vicinity of the tip, so that a discharge phenomenon is produced.

The other type includes a pair of electrodes, which are an induction electrode embedded in a high-breakdown-voltage dielectric and a discharge electrode disposed on a surface of the dielectric. When a high voltage is applied between the electrodes of the ion generating unit of this type, an electric field concentration occurs in the vicinity of an outer edge portion of the discharge electrode on the surface of the dielectric and electrical breakdown of the air occurs in the vicinity of the outer edge portion, so that a discharge phenomenon is produced.

Japanese Unexamined Patent Application Publication No. 2002-374670 (see PTL 1) describes an example of an ion generating device according to the related art. This ion generating device is of the type which includes a discharge electrode as an ion generating electrode and includes no counter electrode. In this ion generating device, a piezoelectric transformer that supplies a high voltage to the ion generating electrode and a drive circuit for driving the piezoelectric transformer are mounted in a casing in an integrated manner through molding. The ion generating electrode is disposed outside the casing and connected to a cable that extends from the inside of the casing.

Japanese Unexamined Patent Application Publication No. 2008-016345 (see PTL 2) discloses a structure of an ion generating device whose thickness is reduced by two-dimensionally arranging an ion generating unit, a transformer drive circuit, and a transformer in a casing and disposing the transformer separately from a circuit board.

CITATION LIST

Patent Literature

PTL 1: Japanese Unexamined Patent Application Publication No. 2002-374670

PTL 2: Japanese Unexamined Patent Application Publication No. 2008-016345

SUMMARY OF INVENTION

Technical Problem

According to the ion generating device described in PTL 2, the thickness of the ion generating device is reduced to some extent by arranging the transformer, the circuit board, and the ion generating unit in partitioned areas in the casing. However, a mass-produced ready-made connector formed by resin molding is used to supply electric power from an external power supply to the ion generating device, and it is difficult to make the ion generating device small enough to be mountable in a small apparatus, such as a portable apparatus.

The present invention has been made in view of the above-described problem, and an object of the present invention is to provide an ion generating device and an electrical apparatus including the ion generating device whose size and thickness can be easily reduced.

Solution to Problem

An ion generating device according to the present invention includes a transformer drive circuit, a transformer, an ion generating unit, a casing, and a connection terminal. The transformer is driven by the transformer drive circuit to boost a voltage. The ion generating unit generates either or both of positive ions and negative ions by receiving the voltage boosted by the transformer. The casing houses the transformer drive circuit, the transformer, and the ion generating unit. An arrangement area of the transformer drive circuit, an arrangement area of the transformer, and an arrangement area of the ion generating unit are two-dimensionally divided from each other in the casing. The connection terminal is electrically connected to the transformer drive circuit and formed of a conductive film arranged to be exposed to the outside of the casing.

The ion generating device according to the present invention includes, in place of a connector, the connection terminal formed of the conductive film as a connecting portion for connecting the ion generating device to an external device. Therefore, the height and depth of the installation space for the connector can be eliminated and the size and thickness of the ion generating device can be reduced.

In addition, since the arrangement area of the transformer drive circuit, the arrangement area of the transformer, and the arrangement area of the ion generating unit are two-dimensionally divided from each other, the thickness of the casing can be set so as to match the height of the transformer, and the thickness of the ion generating device can be reduced.

Preferably, the above-described ion generating device further includes a contact board on which the connection terminal is formed, and both ends of the contact board are supported by the casing so that the contact board is attached to the casing.

In such a case, the contact board may be prepared separately from the casing before the assembly of the ion generating device, and the connection terminal may be easily formed on the contact board and connected to the transformer drive circuit.

Preferably, the above-described ion generating device further includes a drive circuit board that supports the transformer drive circuit and an ion generating unit board that supports the ion generating unit. At least one of the drive circuit board and the ion generating unit board is configured so as to support an inner surface of the contact board at a side opposite an outer surface of the contact board on which the connection terminal is formed.

Thus, the inner surface of the contact board, which is pressed by, for example, an input/output terminal, is supported by at least one of the drive circuit board and the ion generating unit board. Therefore, the contact board can be prevented from making the connection state unstable by being bent.

In the above-described ion generating device, preferably, at least one of the drive circuit board and the ion generating unit board includes a projection for supporting the inner surface of the contact board.

Thus, a certain area of the inner surface of the contact board can be selectively supported by the projection, and the contact board can be efficiently prevented from, for example, being bent. When the certain area of the inner surface of the contact board is selectively supported by the projection, freedom of arrangement of components, such as elements, on the inner surface of the contact board can be increased. In addition, when the certain area of the inner surface of the contact board is selectively supported by the projection, a gap is provided between the contact board and the board that supports the contact board. Therefore, a molding material easily spreads, through the gap, to the front side and bottom side of the board that supports the contact board.

In the above-described ion generating device, preferably, the drive circuit board and the ion generating unit board are arranged separately from each other in the casing. The transformer is arranged between the drive circuit board and the ion generating unit board.

Since the ion generating unit board and the drive circuit board are separated from each other, when an area including the drive circuit is molded after the ion generating unit board and the drive circuit board are installed into the casing, the area to be molded and the area not to be molded can be clearly separated from each other and the molding process can be facilitated.

Preferably, the above-described ion generating device further includes another circuit arranged in the casing. The connection terminal includes a power-supply connection terminal that is electrically connected to an external power supply to supply electric power to the ion generating unit and an external-control-element connection terminal that is electrically connected to an external control element to allow signal communication between the external control element and the other circuit. The external-control-element connection terminal is short-circuited to the power-supply connection terminal in the casing.

In this case, whether or not the ion generating device is mounted on an apparatus can be detected by the external control device.

An electrical apparatus according to the present invention includes any of the above-described ion generating devices and an air blow portion for causing an airflow to carry the ions generated by the ion generating device to the outside of the electrical apparatus.

According to the electrical apparatus of the present invention, the air blow portion causes the airflow to carry the ions generated by the ion generating device. Therefore, for example, the ions can be emitted to the outside of an air-conditioning device or to the inside or outside of a refrigerator.

Advantageous Effects of Invention

As described above, according to the present invention, an ion generating device whose size and thickness can be easily reduced and an electrical apparatus including the ion generating device can be provided.

DESCRIPTION OF EMBODIMENTS

Figure 1:
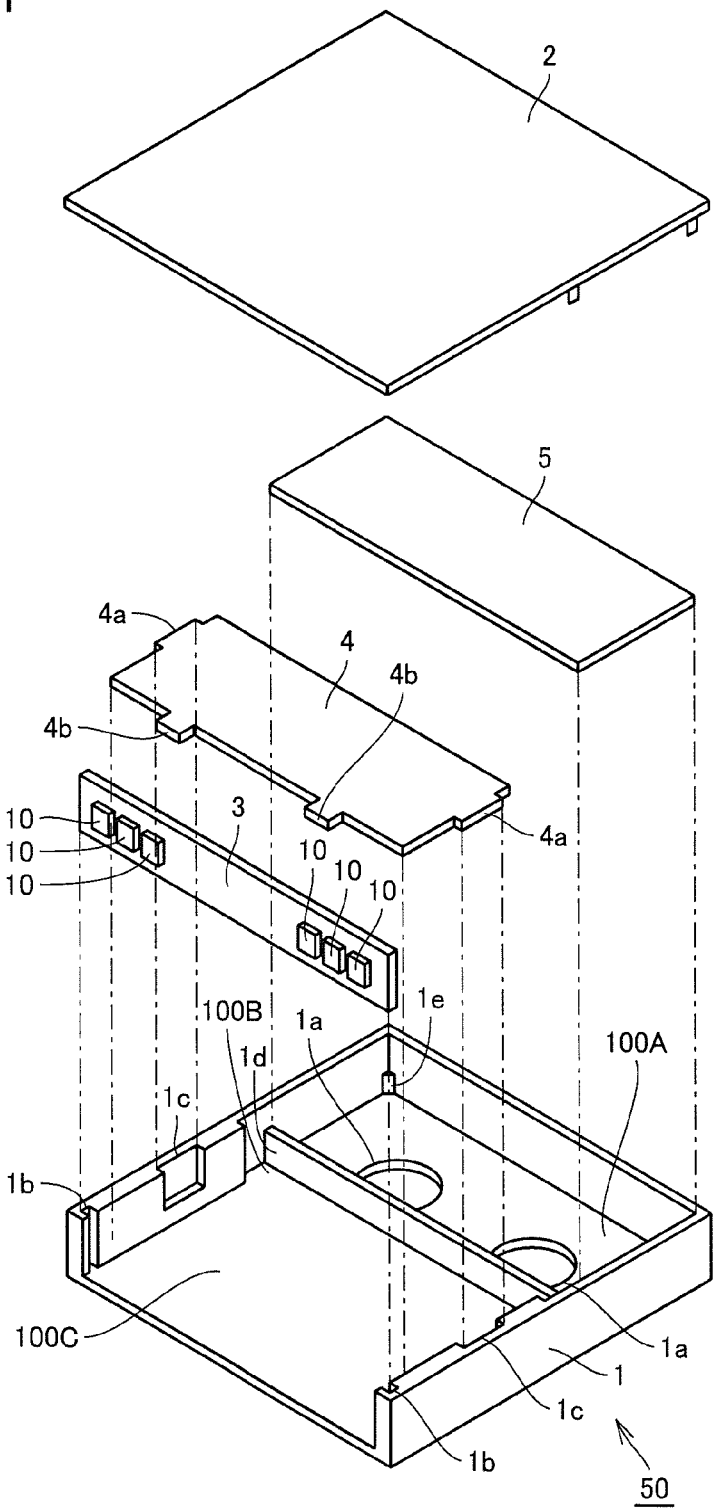
FIG. 1 is an exploded perspective view of an ion generating device according to an embodiment of the present invention, illustrating the state in which parts of the ion generating device are separated from each other.

An embodiment of the present invention will be described with reference to the drawings.

First a structure of an ion generating device according to the present embodiment will be described with reference to FIGS. 1 to 4.

Referring mainly to FIGS. 1 to 4, an ion generating device 50 according to the present embodiment mainly includes a casing 1, a lid body 2, a contact board 3, a transformer drive circuit board 4, an ion generating unit board 5, and a high-voltage transformer 11. The contact board 3, the transformer drive circuit board 4, the ion generating unit board 5, and the high-voltage transformer 11 are housed in the casing 1. In this state, the casing 1 is sealed by the lid body 2.

A high-voltage transformer drive circuit is disposed on the transformer drive circuit board 4. The high-voltage transformer drive circuit receives an input voltage from the outside to drive the high-voltage transformer 11. The high-voltage transformer 11 is driven by the high-voltage transformer drive circuit to boost the input voltage. An ion generating unit is disposed on the ion generating unit board 5. The ion generating unit receives the voltage boosted by the high-voltage transformer 11 to generate either or both of positive ions and negative ions.

Referring mainly to FIG. 1, the inside of the casing 1 is two-dimensionally divided into an ion generating unit block 100A for receiving the ion generating unit, a high-voltage transformer block 1005 for receiving the high-voltage transformer 11, and a high-voltage transformer drive circuit block 100C for receiving the high-voltage transformer drive circuit. In the plan view of FIG. 3, the ion generating unit block 100A is the area in which the ion generating unit board 5 is arranged, and the high-voltage transformer drive circuit block 100C is the area in which the transformer drive circuit board 4 is arranged. The high-voltage transformer 11 is disposed in the high-voltage transformer block 1003 without being mounted on a board.

Figure 3:
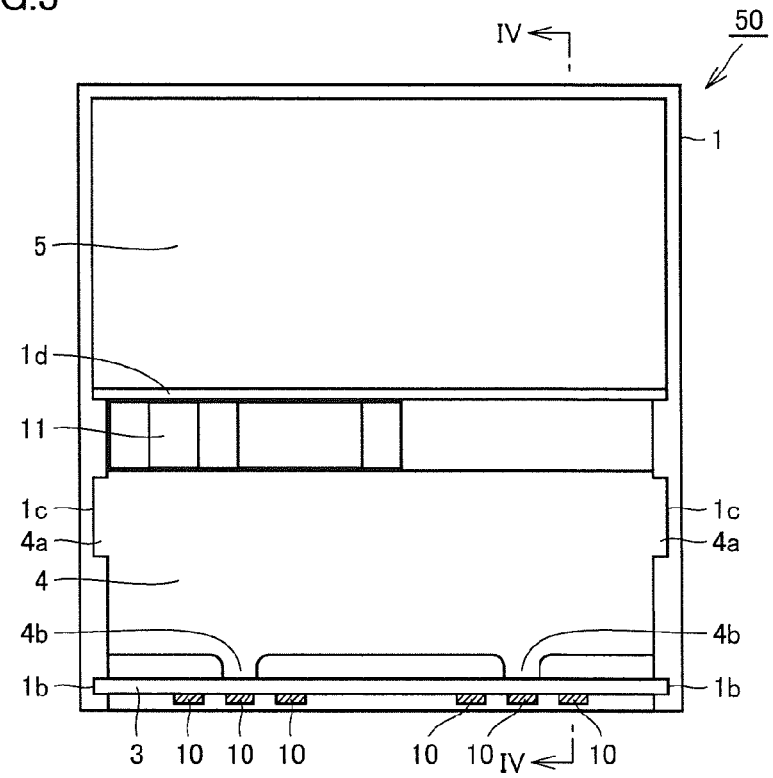
FIG. 3 is a plan view of the ion generating device according to the embodiment of the present invention in which the lid body is omitted.

Here, "two-dimensionally divided" means that the blocks 100A, 100B, and 100C are divided from each other in plan view as illustrated in FIG. 3 (when viewed in a direction perpendicular to the bottom surface of the casing 1). In addition, "blocks 100A, 100B, and 100C are divided from each other" means that the transformer drive circuit board 4, the ion generating unit board 5, and the transformer 11 arranged in the blocks 100A, 100B, and 100C, respectively, do not overlap each other in a thickness direction. The transformer 11 includes terminals 113 and 114 which may have portions that two-dimensionally overlap the transformer drive circuit board 4 and the ion generating unit board 5 to provide electrical connection to the boards 4 and 5. However, two-dimensional overlapping (overlapping in the thickness direction) between the terminals 113 and 114 and the boards 4 and 5 is not considered.

Referring mainly to FIG. 1, the casing 1 has the shape of a box with an open top and an open side. Two ion emission holes 1*a*, for example, are formed in the bottom surface of the ion generating unit block 100A so as to face an ion generating unit on the ion generating unit board 5. A rib 1*d* is formed on the bottom surface of the casing 1 in a central area of the bottom surface. The rib 1*d* serves as a partition between the ion generating unit block 100A and the high-voltage transformer block 100B. The rib 1*d* has a function of preventing mold resin from entering the ion generating unit block 100A when the high-voltage transformer drive circuit block 100C is molded to prevent leakage after the arrangement is completed.

Figure 2:
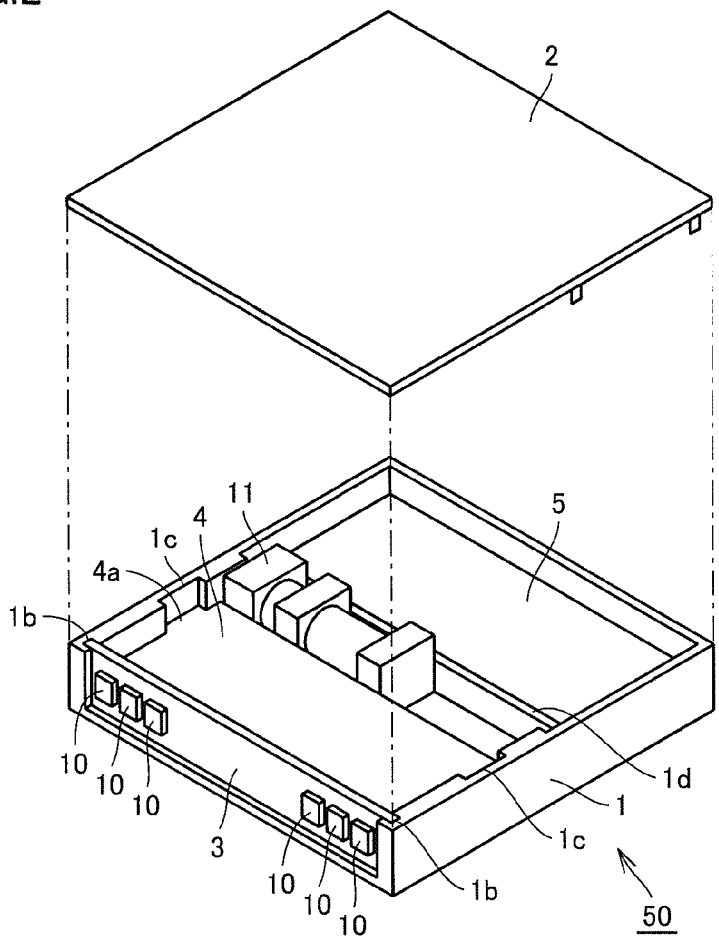
FIG. 2 is an exploded perspective view of the ion generating device according to the embodiment of the present invention, illustrating the state in which a casing and a lid body are separated from each other.

Referring mainly to FIGS. 1 and 2, grooves 1*b* and 1*b* for positioning and supporting the contact board 3 are formed in the casing 1. Both ends of the contact board 3 are supported by the casing 1 and attached to the casing 1 by being inserted into the grooves 1*b* and 1*b*.

Positioning recesses 1*c* and 1*c* for positioning and supporting the transformer drive circuit board 4 are formed in the high-voltage transformer drive circuit block 100C of the casing 1. Positioning protrusions 4*a* and 4*a* of the transformer drive circuit board 4 on which the transformer drive circuit is mounted are fitted into the positioning recesses 1*c* and 1*c*, so that the transformer drive circuit board 4 is positioned and attached to the casing 1.

Projections 1*e* and 1*e* for positioning the ion generating unit board 5 in the height direction by supporting the bottom surface of the ion generating unit board 5 are formed in the ion generating unit block 100A of the casing 1. The bottom surface of the ion generating unit board 5 to which the ion generating unit is attached is brought into contact with the top ends of the projections 1*e* and 1*e* and the rib 1*d*, so that the ion generating unit board 5 is positioned and attached to the casing 1.

Figure 4:
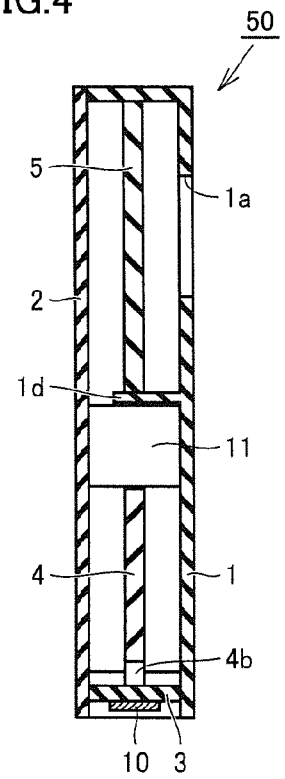
FIG. 4 is a sectional view of the ion generating device in which the lid body is attached to the structure illustrated in FIG. 3, taken along the line IV-IV.

Referring mainly to FIGS. 2 and 4, the lid body 2 is attached to the casing 1 by being arranged so that the lid body 2 is in contact with each of the top end surface of the casing 1 and the top end surface of the contact board 3.

A plurality of connection terminals 10 (for example, six connection terminals 10) are provided on a surface of the contact board 3. Each of the connection terminals 10 is formed of a conductive film on the surface of the contact board 3, and is formed by, for example, pattern printing, plating, sputtering, or chemical vapor deposition (CVD). The conductive film is made of, for example, copper (Cu), aluminum (Al), gold (Au), or an alloy thereof, and has a film thickness in the order of several tens of micrometers (for example, 35 μm). Each connection terminal 10 is arranged so as to be exposed to the outside of the casing 1 when the contact board 3 is supported by the casing 1.

Of the plurality of connection terminals 10 (for example, six connection terminals 10), one set of connection terminals 10 (for example, three connection terminals 10) is arranged on one of the end portions of the contact board 3 and another set of connection terminals 10 (for example, the remaining three connection terminals 10) is arranged on the other one of the end portions of the contact board 3 separately from the prior set of connection terminals 10. Accordingly, the prior set of connection terminals 10 and the other set of connection terminals 10 may be easily electrically connected to different external electrical elements. For example, the prior set of connection terminals 10 may be connected to an external power supply for supplying electric power to the transformer drive circuit, and the other set of connection terminals 10 may be connected to an external control device for communicating information with another circuit, which will be described below.

At least one of the transformer drive circuit board 4 and the ion generating unit board 5 supports the inner surface of the contact board 3 when the transformer drive circuit board 4 and the ion generating unit board 5 are attached to the casing 1. In the present embodiment, the transformer drive circuit board 4 includes, for example, two projections 4*b* and 4*b*. The two projections 4*b* and 4*b* support the contact board 3 by coming into contact with the inner surface of the contact board 3. The two projections 4*b* and 4*b* are in contact with the inner surface in an area corresponding to the area in which the prior set of connection terminals 10 is arranged and an area corresponding to the area in which the other set of connection terminals 10 is arranged.

Another circuit is mounted on the inner surface of the contact board 3. The other circuit includes, for example, a storage device that stores product data and operation time of the ion generating device. The other circuit is arranged on the inner surface of the contact board 3 in an area excluding the area in which at least one of the transformer drive circuit board 4 and the ion generating unit board 5 is in contact with the inner surface of the contact board 3 (for example, the areas in which the projections 4*b* and 4*b* are in contact with the inner surface).

The connection terminals 10 are electrically connected to the transformer drive circuit and the other circuit on the inner surface of the contact board 3, as described below. The contact board 3 has through holes formed therein, and the connection terminals 10 or the front surface of the contact board are electrically connected to a conductive pad layer on the back surface of the contact board through the through holes. Each of the connection terminals 10 is electrically connected to the transformer drive circuit or the other circuit by a lead wire that is, for example, soldered to the conductive pad layer.

Figure 5:
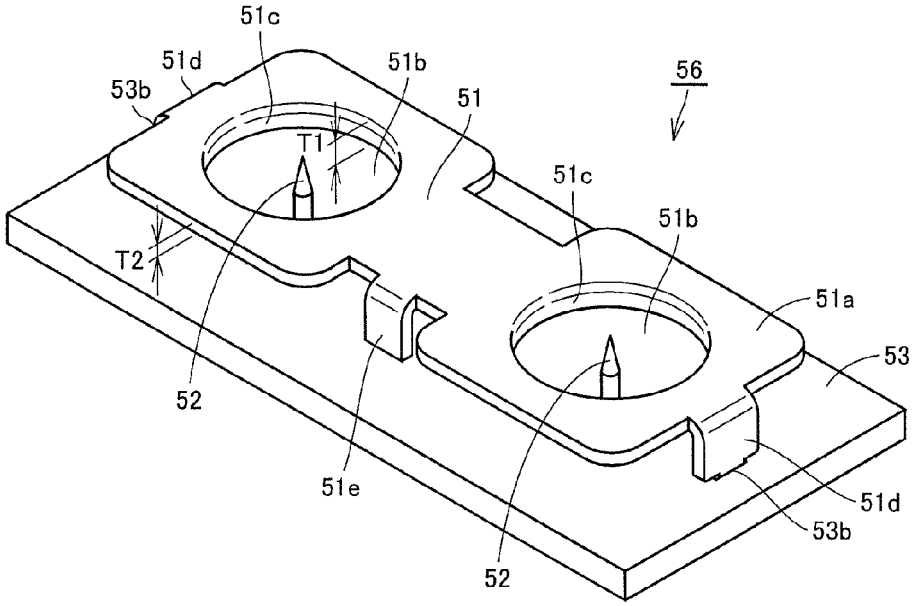
FIG. 5 is a perspective view illustrating a structure of an ion generating unit included in the ion generating device according to the embodiment of the present invention.

The structure of the ion generating unit will now be concretely described with reference to FIG. 5. Referring to FIG. 5, an ion generating unit 56 according to the present embodiment generates either or both of positive ions and negative ions by, for example, corona discharge, and includes an induction electrode 51, discharge electrodes 52, and a supporting substrate 53. The induction electrode 51 is formed of a one-piece metal plate and includes a top plate portion 51*a* in which a plurality of through holes 51*b*, the number of which corresponds to the number of discharge electrodes 52, are formed. The through holes 51*b* are openings through which the ions generated by the corona discharge are emitted to the outside of the ion generating unit. In the present embodiment, for example, the number of through holes 51*b* is two and the through holes 51*b* have a circular shape in plan view. Each through hole 51*b* has a bent portion 51*c* along the rim thereof, the bent portion 51*c* being formed by bending the metal plate with respect to the top plate portion 51*a* by a method such as drawing. Owing to the bent portion 51*c*, the thickness T1 of a wall portion along the rim of each through hole 51*b* is larger than the thickness T2 of the top plate portion 51*a*.

The induction electrode 51 includes substrate insertion portions 51*d* at, for example, both ends thereof. The substrate insertion portions 51*d* are formed by bending parts of the metal plate with respect to the top plate portion 51*a*. Each substrate insertion portion 51*d* includes a support portion having a large width and an insertion portion having a small width. The support portion is connected to the top plate portion 51*a* at one end thereof and to the insertion portion at the other end thereof.

The induction electrode 51 may include a substrate support portion 51*e* formed by bending a part of the metal plate with respect to the top plate portion 51*a*. The substrate support portion 51*e* is bent in the same direction as the bending direction of each substrate insertion portion 51*d*. The length of the substrate support portion 51*e* in the bending direction is approximately the same as the length of the support portion, which has a large width, of each substrate insertion portion 51*d* in the bending direction.

Each discharge electrode 52 has a needle-like tip. The supporting substrate 53 has through holes for allowing the discharge electrodes 52 to be inserted therethrough and through holes 53*b* for allowing the insertion portions of the substrate insertion portions 51*d* to be inserted therethrough. The needle-like discharge electrodes 52 are supported by the supporting substrate 53 so as to extend through the supporting substrate 53 by being inserted or press-fitted into the through holes. Accordingly, the needle-like end of each discharge electrode 52 protrudes from the front surface of the supporting substrate 53 and the other end, which protrudes from the back surface of the supporting substrate 53, may be electrically connected to a lead wire or a wiring pattern by using solder.

The supporting substrate 53 of the ion generating unit 56 may either be the same member as the above-described ion generating unit board 5 or a member different from the ion generating unit board 5.

Figure 6:
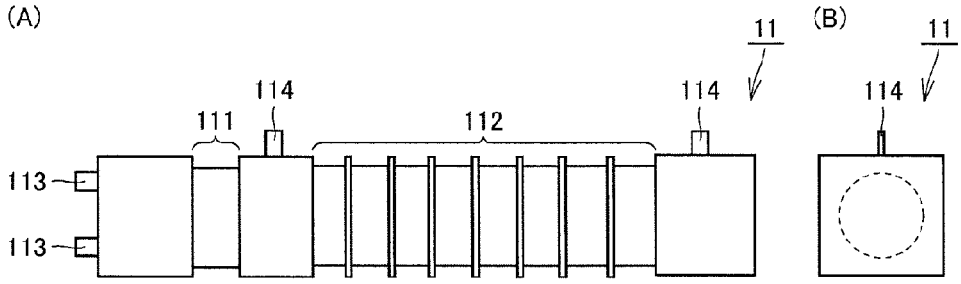
FIG. 6 Part (A) is a plan view illustrating a structure of a high-voltage transformer included in the ion generating device according to the embodiment of the present invention, and part (B) is a side view illustrating the structure of the high-voltage transformer.

The structure of the high-voltage transformer will now be concretely described with reference to FIG. 6. Referring to FIG. 6, the high-voltage transformer 11 according to the present exemplary embodiment is a winding transformer. The height, depth, and length of the high-voltage transformer are, for example, about 6 mm, 6 mm, and 18 mm, respectively. The winding transformer 11 is configured such that a primary winding 111 and a secondary winding 112, which are insulated from each other, are provided around a bobbin that surrounds an iron core. The primary winding 111 and the secondary winding 112 are arranged side by side. Generally, a voltage generated on the secondary side of the winding transformer 11 is determined by a turn ratio between the primary winding 111 and the secondary winding 112 and an inductance. To generate a high voltage, the number of turns of the secondary winding 112 is generally required to be several thousand. When the winding whose number of turns is several thousand is provided around the bobbin in a narrow area thereof, the thickness of the winding transformer 11 is increased. Therefore, instead of winding a wire around the bobbin several thousand turns at one time, it is preferable to adopt a bobbin structure in which a single winding is divided into as many layers as possible to reduce the number of turns in each layer, so that the overall thickness can be reduced. If the number of layers into which the winding is divided is excessively increased, the length of the winding transformer 11 increases, which is disadvantageous for size reduction. Therefore, the winding is preferably divided into an appropriate number of layers.

Both terminals 113 and 113 of the primary winding 111 are disposed on an end portion of the winding transformer 11 in a longitudinal direction thereof (in a direction in which the primary winding 111 and the secondary winding 112 are arranged next to each other). Both terminals 114 and 114 of the secondary winding 112 are disposed on a side portion of the transformer 11. The terminals 113 and 113 of the primary winding are connected to the transformer drive circuit board 4, and the terminals 114 and 114 of the secondary winding are connected to the ion generating unit board 5.

The state in which the functional elements included in the ion generating device according to the present embodiment are electrically connected will now be described with reference to FIG. 7.

Figure 7:
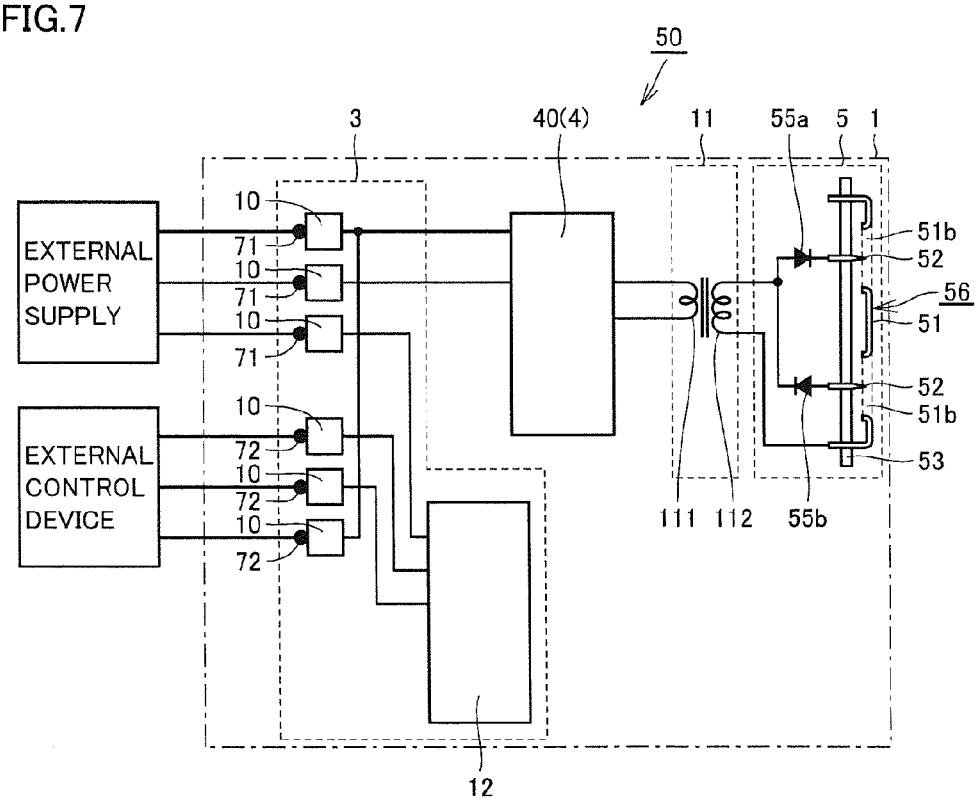
FIG. 7 is a functional block diagram of the ion generating device according to the embodiment 1 of the present invention, illustrating electrical connections between functional elements.

Referring to FIG. 7, as described above, the ion generating device 50 includes the casing 1, the ion generating unit 56 mounted on the ion generating unit board 5, the high-voltage transformer 11, a transformer drive circuit 40 mounted on the transformer drive circuit board 4, another circuit 12, and the connection terminals 10. The connection terminals 10 are exposed to the outside of the casing 1, and are configured such that the external power supply and the external control device are connectable thereto from the outside.

The contact board 3 is provided with, for example, the six connection terminals 10 divided into two sets of three connection terminals. The connection terminals 10 of one set are connected to terminals (input/output contact points) 71 of the external power supply, so that electric power is supplied to the transformer drive circuit 40 mounted on the transformer drive circuit board 4 and the other circuit 12 through the connection terminals 10 of the prior set. The connection terminals 10 of the other set are connected to terminals (input/output contact points) 72 of the external control device so that signals can be communicated between the external control device and the other circuit 12 through the connection terminals 10 of the other set.

The transformer drive circuit 40 is electrically connected to the primary winding 111 of the high-voltage transformer 11. The high-voltage transformer 11 boosts the voltage input to the primary winding 111 and outputs the boosted voltage to the secondary winding 112. One end of the secondary winding 112 of the high-voltage transformer 11 is electrically connected to the induction electrode 51 of the ion generating unit, and the other end of the secondary winding 112 is electrically connected to the discharge electrodes 52 through diodes 55*a* and 55*b*.

The diodes 55*a* and 55*b* are connected such that a high voltage having a positive polarity with respect to the induction electrode 51 is applied to the discharge electrode 52 that generates positive ions and a high voltage having a negative polarity with respect to the induction electrode 51 is applied to the discharge electrode 52 that generates negative ions. In this way, ions of both polarities, that is, positive and negative ions, can be generated. The state in which the diodes 55*a* and 55*b* are connected may, of course, be changed so that only positive ions or negative ions are generated.

One of the connection terminals 10 connected to the external power supply (power-supply connection terminals) is electrically short-circuited to one of the connection terminals 10 connected to the external control device (external-control-element connection terminals) in the ion generating device 50. Accordingly, when the ion generating device 50 is mounted on an electronic apparatus, the external Power supply and the external control device are electrically connected to each other. Therefore, a power supply voltage (for example, 3V) is input from the external power supply to the external control device through the ion generating device 50, and the external control device can detect whether or not the ion generating device 50 is mounted on the electronic apparatus by determining whether or not the power supply voltage is input. When the external control device cannot detect that the ion generating device 50 is mounted on the electronic apparatus even when the ion generating device 50 is mounted on the electronic apparatus, it can be determined that an electrical contact failure has occurred.

In the state in which the ion generating device 50 is mounted on the electronic apparatus, the external control device is electrically connected to the other circuit 12. Accordingly, the ion generating device 50 may cause the other circuit 12 to store the product data and history of the ion generating device 50 and transmit the product data and other data of the ion generating device 50 to a control device of, for example, the electrical apparatus when the ion generating device 50 is mounted on the electrical apparatus. The control device that has received the data may determine whether or not the mounted ion generating device 50 is usable on the basis of a predetermined setting. Thus, the electrical apparatus or the like can always use a regular in generating device. Even when the ion generating device is a regular product, the history may be checked to prevent a product having a history of breakdown or a product that has already been used for a predetermined life from being used by mistake.

The operational effects of the ion generating device according to the present embodiment compared to the case in which a relay connector is used instead of the connection terminals will now be explained.

In the case where a connector that is generally called a female connector of a relay connector is used as a connector for connecting the ion generating device to an external device, the connector is about 12 mm wide, 7 mm high, and 12 mm deep and is attached to the ion generating device so as to partially project from the ion generating device. The relay connector retains a plurality of contacts in a casing made of resin, and includes a pair of connectors including a male connector provided at an insertion side and a female connector provided at a receiving side. The relay connector is mass-produced by a specialized manufacturer. The main part of the ion generating device including the female connector of the relay connector is about 77 mm wide, 9 mm high, and 22 mm deep, and the distance by which the connector projects from the main part is about 4 mm.

In contrast, the ion generating device 50 according to the present embodiment includes, in place of the relay connector, the connection terminals 10 formed of a conductive film as a connecting portion for connecting the ion generating device 50 to an external device. Therefore, the height and depth of the installation space for the connector can be eliminated and the size and thickness of the ion generating device 50 can be reduced. Specifically, as a result of removing the relay connector from the ion generating device, the size of the main body of the ion generating device can be reduced to about 40 mm wide, 6 mm high, and 37 mm deep. Thus, the size and thickness of the main body can be greatly reduced compared to those in the above-described case in which the relay connector is used. Therefore, the ion generating device 50 according to the present embodiment may be widely used in, for example, portable electrical apparatuses.

In the ion generating device 50 according to the present embodiment, the arrangement area of the transformer drive circuit 40, the arrangement area of the high-voltage transformer 11, and the arrangement area of the ion generating unit 56 are two-dimensionally divided from each other, as illustrated in FIGS. 2 and 3. Therefore, the transformer drive circuit 40, the high-voltage transformer 11, and the ion generating unit 56 do not overlap each other in the thickness direction of the casing 1. As a result, the thickness of the casing 1 can be set so as to match the height (thickness) of the high-voltage transformer 11, and the thickness of the ion generating device 50 can be reduced.

In the ion generating device having the above-described structure, the connection terminals 10 are exposed to the outside of the casing 1 when the contact board 3 is attached to the casing 1. Accordingly, input/output contact points (not shown) on an ion generating device receiving portion of an electrical apparatus configured such that the ion generating device 50 can be mounted thereon can be easily and reliably brought into contact with the connection terminals 10. With this structure, the height and depth of the ion generating device can both be reduced compared to those of the above-described ion generating device including the relay connector.

However, since the input/output contact points 71 and 72 of the electrical apparatus are brought into contact with the connection terminals 10 of the contact board 3 by being pressed against the connection terminals 10, there is a risk that the contact board 3 will be bent toward the inside of the casing 1. Accordingly, in the present embodiment, at least one of the transformer drive circuit board 4 and the ion generating unit board 5 is configured so as to support the inner surface of the contact board 3 at the side opposite the outer surface of the contact board 3 on which the connection terminals 10 are formed. Therefore, even when a pressing force is applied to the connection terminals 10 by the input/output terminals 71 and 72 of an external device, the contact board 3 can be prevented from being bent inward. Thus, the contact board 3 can be prevented from making the connection state unstable by being bent.

Specifically, the transformer drive circuit board 4 includes the projections 4*b* and 4*b* for supporting the inner surface of the contact board 3. Certain areas of the inner surface of the contact board 3 can be selectively supported by the projections 4*b* and 4*b*, and the contact board 3 can be efficiently prevented from, for example, being bent.

Although the transformer drive circuit board 4 supports the inner surface of the contact board 3 in the above-described structure, the inner surface of the contact board 3 may instead be supported by the ion generating unit board 5. Alternatively, the inner surface of the contact board 3 may be supported by both the transformer drive circuit board 4 and the ion generating unit board 5.

The transformer drive circuit board 4 includes the positioning protrusions 4*a* and 4*a*, and the transformer drive circuit board 4 is positioned in the casing 1 by fitting the positioning protrusions 4*a* and 4*a* into the positioning recesses 1*c* and 1*c* in the casing 1. Therefore, even when the pressing force is applied to the contact board 3, the contact board 3 is not bent and reliable connection is achieved by the connection terminals 10.

In addition, in the present embodiment, both ends of the contact board 3 are supported by the casing 1 so that the contact board 3 is attached to the casing 1. In other words, the contact board 3 is prepared separately from the casing 1. Therefore, the contact board 3 may be prepared separately from the casing 1 before the assembly of the ion generating device 50, and the connection terminals 10 may be easily formed on the contact board 3 and connected to the transformer drive circuit.

The transformer drive circuit board 4 and the ion generating unit board 5 are arranged separately from each other in the casing 1, and the transformer 11 is arranged therebetween. Since the ion generating unit board 5 and the transformer drive circuit board 4 are separated from each other, when an area including the transformer drive circuit 40 is molded after the ion generating unit board 5 and the transformer drive circuit board 4 are installed into the casing 1, the area to be molded and the area not to be molded can be clearly separated from each other and the molding process can be facilitated.

When ions of either polarity, that is, either positive ions or negative ions, are generated by the above-described ion generating device 50, as illustrated in FIG. 5, the needle-like tips of the discharge electrodes 52 that generate the ions are aligned with the centers of the through holes 51*b* in the induction electrode 51 and positioned within the thickness T1 of the through holes 51*b* in the induction electrode 51. Thus, the induction electrode 51 faces the needle-like tip of each discharge electrode 52 with an air space provided therebetween.

When ions of both polarities, that is, both positive and negative ions, are to be emitted, as illustrated in FIG. 5, the needle-like tip of the discharge electrode 52 that generates positive ions and the needle-like tip of the discharge electrode 52 that generates negative ions are arranged with a predetermined distance therebetween. The needle-like tips of the discharge electrodes 52 are aligned with the centers of the through holes 51*b* in the induction electrode 51 and positioned within the thickness T1 of the through holes 51*b* in the induction electrode 51. Thus, the induction electrode 51 faces the needle-like tip of each discharge electrode 52 with an air space provided therebetween.

In the above-described ion generating unit, when the plate-shaped induction electrode 51 and the needle-like discharge electrodes 52 are arranged with predetermined distances therebetween as described above and a high voltage is applied between the induction electrode 51 and the discharge electrodes 52, a corona discharge occurs at the tips of the needle-like discharge electrodes 52. Either or both of positive ions and negative ions are generated by the corona discharge, and the generated ions are emitted to the outside of the ion generating unit through the through holes 51*b* formed in the induction electrode 51. The ions can be more effectively emitted when an air blow portion is additionally provided.

In the case where both positive and negative ions are generated, positive ions are generated by generating a positive corona discharge at the tip of one of the discharge electrodes 52, and negative ions are generated by generating a negative corona discharge at the tip of the other one of the discharge electrodes 52. The waveform to be applied is not particularly limited herein. For example, a direct current, a positively or negatively biased alternating current, or a positively or negatively biased pulse wave at a high voltage may be applied. The voltage value is set to be high enough to generate the discharge and is selected from a voltage range in which predetermined ion species can be generated.

Here, the positive ions are cluster ions in each of which a plurality of water molecules are attached to a hydrogen ion ($H^+$), and are represented by $H^+(H_2O)$, (m is any natural number). The negative ions are cluster ions in each of which a plurality of water molecules are attached to an oxygen ion ($O_2^-$), and are represented by $O_2^-(H_2O)$, (n is any natural number).

In the case where the ions of both polarities, that is, both positive and negative ions, are emitted, approximately the same amount of $H^+(H_2O)_m$ (m is any natural number), which is the positive ions in the air, and $O_2^-(H_2O)$, (n is any natural number), which is the negative ions in the air, may be generated, so that the ions of both polarities surround fungi and viruses floating in the air. At this time, hydroxyl radicals (—OH), which are active species, are generated and the floating fungi and the like can be eliminated as a result of the reaction of the hydroxyl radicals.

A structure of an air purifier, which is an example of an electrical apparatus including the ion generating device according to the above-described embodiment, will be described with reference to FIGS. 8 and 9.

Figure 8:
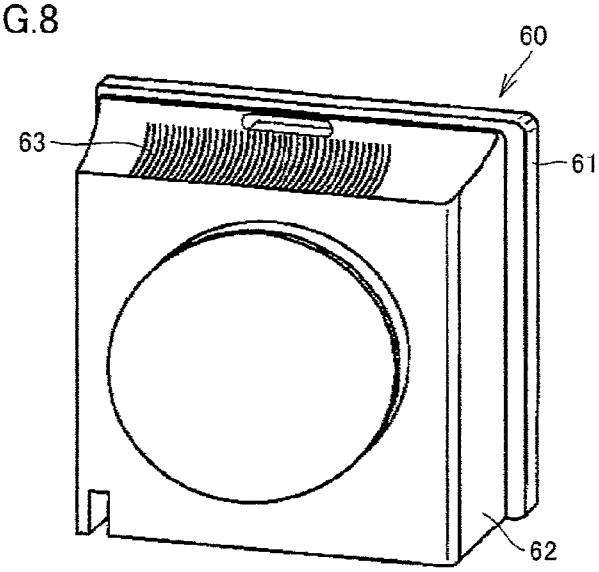
FIG. 8 is a perspective view schematically illustrating a structure of an air purifier that includes the ion generating device according to the embodiment of the present invention.
Figure 9:
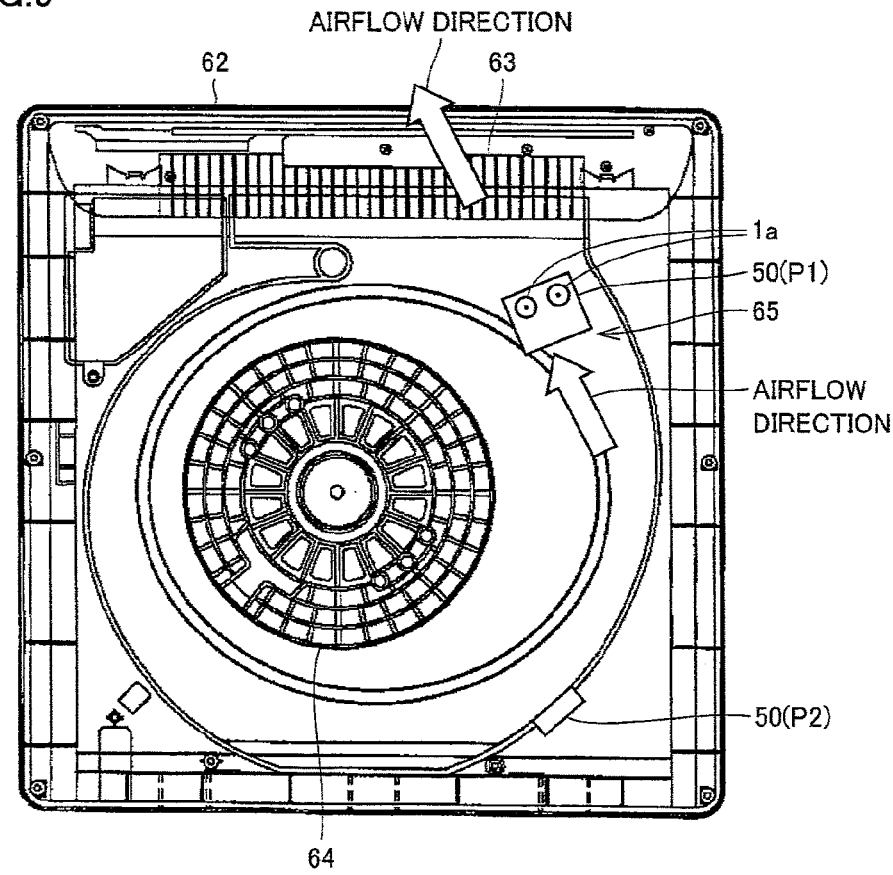
Prior Art FIG.9
FIG. 9 is an exploded view of the air purifier, illustrating how the ion generating device is disposed in the air purifier shown in FIG. 8.

Referring to FIGS. 8 and 9, an air purifier 60 includes a front panel 61 and a main body 62. An outlet 63 is formed in an upper rear portion of the main body 62, and clean air containing ions is supplied to the room through the outlet 63. An air intake port 64 is formed at the center of the main body 62. The air that has been taken in through the air intake port 64, which is provided at the front side of the air purifier 60, passes through a filter (not shown) so that the air is cleaned. The cleaned air flows through a fan casing 65 and is emitted to the outside through the outlet 63.

The ion generating device 50 described in the above-described embodiment is attached to a part of the fan casing 65 that defines a passage of the cleaned air. The ion generating device 50 is disposed such that ions can be emitted into the above-described airflow through the through holes 1*a*, which serve as an ion generating unit. The ion generating device 50 may be disposed in the air passage at, for example, a position P1 that is relatively close to the outlet 63 or a position P2 that is relatively far from the outlet 63. When the air is caused to flow along the through holes 1*a* in the ion generating device 50, the air purifier 60 serves an ion generating function, which is a function of emitting ions to the outside through the outlet 63 together with the clean air.

According to the air purifier 60 of the present embodiment, an air blow portion (air passage) allows the ions generated by the ion generating device 50 to be carried by the airflow, so that the ions can be emitted to the outside of the air purifier 60.

Although an air purifier is described as an example of an electrical apparatus in the present embodiment, the present invention is not limited to this. The electrical apparatus may instead be, for example, an air-conditioning unit (air-conditioner), a cooling apparatus, a vacuum cleaner, a humidifier, a dehumidifier, or an electric fan heater as long as the electrical apparatus includes an air blow portion for causing the airflow to carry the ions.

In the above-described structure, the power supply (input power supply) to be input to the ion generating device 50 may be either a commercial alternating-current power supply or a direct-current power supply. When the input power supply is a commercial alternating-current power supply, it is necessary to provide a legally defined distance between the components included in the high-voltage transformer drive circuit, which is the primary-side circuit, and between patterns on a printed board. The components are required to be resistant to the power supply voltage, which leads to an increase in size. However, the circuit structure is simple and the number of components can be reduced.

When the input power supply is a direct-current power supply, the restriction to the distance between the components included in the high-voltage transformer drive circuit, which is the primary-side circuit, and between the patterns on the printed board is greatly reduced compared to that in the above-described case in which a commercial alternating-current power supply is used. The components and patterns may be arranged with small distances therebetween, and small components, such as chip components, may be used. Therefore, high-density arrangement can be achieved. However, a complex circuit is required to realize a high-voltage drive circuit, and the number of components is increased compared to that in the above-described case in which an alternating-current power supply is used.

Although the ion generating device 50 includes a single pair of positive/negative ion generating units in the above-described embodiment, two or more pairs of positive/negative ion generating units may instead be provided.

It should be understood that the embodiment disclosed herein is illustrative and not limitative in all aspects. The scope of the present invention is defined not by the foregoing description but by the scope of the claims, and is intended to include meanings equivalent to the scope of the claims and all modifications within the scope.

INDUSTRIAL APPLICABILITY

The present invention is widely applicable to an ion generating device and an electrical apparatus, in particular a portable electrical apparatus, which include a transformer drive circuit, a transformer, and an ion generating unit.

REFERENCE SIGNS LIST

1 casing, 1*a* through hole, 1*b* groove, 1*c* positioning recess, 1*d* rib, 1*e* projection, 2 lid body, 3 contact board, 4 transformer drive circuit board, 4*a* positioning protrusion, 4*b* projection, 5 ion generating unit board, 10 connection terminal, 11 high-voltage transformer, 12 another circuit, 40 transformer drive circuit, 50 ion generating device, 51 induction electrode, 51*a* top plate portion, 51*b* through hole, 51*c* bent portion, 51*d* substrate insertion portion, 51*e* substrate support portion, 52 discharge electrode, 53 supporting substrate, 53*b* through hole, 55*a*, 55*b* diode, 56 ion generating unit, 60 air purifier, 61 front panel, 62 main body, 63 outlet, 64 air intake port, 65 fan casing, 71, 72 terminal (input/output contact point), 100A ion generating unit block, 100B high-voltage transformer block, 100C high-voltage transformer drive circuit block, 111 primary winding, 112 secondary winding, 113, 114 terminal

What is claimed is:

1. An ion generating device comprising:

a transformer drive circuit;

a transformer driven by the transformer drive circuit to boost a voltage;

an ion generating unit that generates either or both of positive ions and negative ions by receiving the voltage boosted by the transformer;

a contact board on which a connection terminal is formed and another circuit is formed on an inner surface of the contact board at a side opposite an outer surface of the contact board on which the connection terminal is formed;

a drive circuit board that supports the transformer driver circuit;

an ion generating unit board that supports the ion generating unit; and a casing that houses the transformer drive circuit, the transformer, and the ion generating unit, wherein both of the connection terminal that is formed of a conductive film and the contact board are arranged to be exposed to the outside of the casing, wherein at least one of the drive circuit board and the ion generating unit board is configured so as to support the inner surface of the contact board.

2. The ion generating device according to claim 1, wherein both ends of the contact board are supported by the casing so that the contact board is attached to the casing.

3. The ion generating device according to claim 1, wherein at least one of the drive circuit board and the ion generating unit board includes a projection for supporting the inner surface of the contact board.

4. The ion generating device according to claim 1, wherein the drive circuit board and the ion generating unit board are arranged separately from each other in the casing, and wherein the transformer is arranged between the drive circuit board and the ion generating unit board.

5. The ion generating device according to claim 1, further comprising:

another circuit arranged in the casing, wherein the connection terminal includes a power-supply connection terminal that is electrically connected to an external power supply to supply electric power to the ion generating unit and an external-control-element connection terminal that is electrically connected to an external control element to allow signal communication between the external control element and the other circuit, and wherein the external-control-element connection terminal is short-circuited to the power-supply connection terminal in the casing.

6. An electrical apparatus comprising:

the ion generating device according to claim 1; and an air blow portion for causing an airflow to carry the ions generated by the ion generating device to the outside of the electrical apparatus.

* * * * *